US007319291B2

(12) United States Patent
Fujitani

(10) Patent No.: US 7,319,291 B2
(45) Date of Patent: Jan. 15, 2008

(54) PLASMA DISPLAY PANEL HAVING DIELECTRIC LAYER WITH CURVED CORNER

(75) Inventor: Morio Fujitani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 208 days.

(21) Appl. No.: 10/507,312

(22) PCT Filed: Jan. 19, 2004

(86) PCT No.: PCT/JP2004/000357

§ 371 (c)(1),
(2), (4) Date: Sep. 10, 2004

(87) PCT Pub. No.: WO2004/066340

PCT Pub. Date: Aug. 5, 2004

(65) Prior Publication Data

US 2005/0242732 A1 Nov. 3, 2005

(30) Foreign Application Priority Data

Jan. 17, 2003 (JP) ..... 2003-009474

(51) Int. Cl.
*H01J 17/49* (2006.01)

(52) U.S. Cl. ..... 313/582; 313/586; 313/587

(58) Field of Classification Search ..... 313/582–587
See application file for complete search history.

(56) References Cited

U.S. PATENT DOCUMENTS 5,736,815 A * 4/1998 Amemiya ..... 313/586
6,008,582 A * 12/1999 Asano et al. ..... 313/582
6,252,353 B1 * 6/2001 Ha et al. ..... 313/582
2001/0035718 A1 * 11/2001 Ha et al. ..... 313/582
2002/0163108 A1 11/2002 Oshio et al.

FOREIGN PATENT DOCUMENTS

EP 0 877 003 A2 11/1998
JP 2000-268737 9/2000
JP 2000-315459 * 11/2000
JP 2001283738 A * 10/2001
JP 2002-124192 4/2002

OTHER PUBLICATIONS

Machine Translation of Yonehara.*
Naotaka Kosugi; "Dielectric Layer Forming Technology"; *FPD Technology Outlook*: c. 2001; pp. 594-597; vol. 5, Article 2, Chapter 5.

* cited by examiner

*Primary Examiner*—Joseph Williams
*Assistant Examiner*—Hana Asmat Sanei
(74) *Attorney, Agent, or Firm*—McDermott Will & Emery LLP

(57) ABSTRACT

A plasma display panel does not cause disadvantages such as exfoliating or chipping in dielectric layers. The plasma display panel includes a first dielectric layer (7) for covering a display electrode which is formed on a front substrate (3) and which consists of a scan electrode and a sustain electrode, and a second dielectric layer for covering a data electrode formed on a back substrate, and the peripheries of the first dielectric layer (7) and/or the second dielectric layer have a radius of curvature of other than 0.

3 Claims, 3 Drawing Sheets

PLASMA DISPLAY PANEL HAVING DIELECTRIC LAYER WITH CURVED CORNER

TECHNICAL FIELD

The present invention relates to plasma display panels known as display devices.

BACKGROUND ART

Plasma display panels provide screen displays by using ultraviolet rays generated by gas discharge so as to excite and illuminate phosphors.

Plasma display devices with such plasma display panels are of high display quality because of their higher speed display, wider angle of vision, and easier upsizing than display devices with liquid crystal panels, and also of being a self luminescence type and of other advantageous features. For this reason, of various flat panel display devices, plasma display devices have been drawing particular attention in these days and widely used, for example, as public display devices at spaces where many people gather or as domestic display devices for enjoying large screens at homes.

Plasma display panels are classified into an AC type and a DC type as driving mode, and are classified into a surface discharge type and an opposed discharge type as discharge mode. From the viewpoint of achieving higher definition, a larger screen size and a simpler structure, surface discharge type AC plasma display panels having a three-electrode structure are going mainstream. An AC plasma display panel is formed of a front plate and a back plate. The front plate includes a front substrate which is a glass substrate, a display electrode which is provided on the front substrate and which consists of a scan electrode and a sustain electrode, and a first dielectric layer which covers the display electrode. On the other hands, the back plate includes a back substrate which is a glass substrate, a plurality of data electrodes which are formed on the back substrate and which are orthogonal at least to the display electrode, and a second dielectric layer which covers the data electrodes. The front plate and the back plate are disposed to face each other so as to form discharge cells at the intersections of the display electrode and the data electrode, and to provide phosphor layers inside the discharge cells.

In the structure of such a plasma display panel, the process of forming the first dielectric layer and/or the second dielectric layer is disclosed, for example, in "2001 FPD Technology Outlook" published by Electronic Journal, Oct. 25, 2000, pp. 594-597. According to this forming process, dielectric paste containing a powdered glass material with a low melting point is applied by screen printing or die coating, then dried, and sintered.

However, plasma display panels with the aforementioned structure have a problem that withstand voltage disadvantages may occur when a driving voltage is applied to the display electrode or the data electrodes, thereby making it impossible to provide an excellent screen display. The withstand voltage disadvantages result from exfoliating, cracking, or chipping developing in the first dielectric layer and/or the second dielectric layer. These exfoliating, cracking, and chipping are considered to be caused by the presence of regions including angular parts at the peripheries of the first and/or second dielectric layers which have been formed on the glass substrates for covering the electrodes. In such a case, for example in a firing process in the production of these dielectric layers, the difference in thermal expansion between the dielectric layers and the glass substrate which is to be the front substrate or the back substrate causes the concentration of stress in the regions including the angular parts. As a result, exfoliating, cracking or chipping occurs in the dielectric layers starting from the angular parts. Even if exfoliating, cracking, or chipping does not occur during the firing process, stress is concentrated on the angular parts after the firing process, so that exfoliating, cracking or chipping is caused by external vibration or impact starting from the angular parts. As a result, withstand voltage disadvantages occur.

The present invention has been contrived in view of this situation, and has an object of achieving a plasma display panel capable of creating an excellent screen display by providing dielectric layers having a reduced occurrence of disadvantages such as exfoliating, cracking, and chipping.

DISCLOSURE OF THE INVENTION

The plasma display panel of the present invention includes a first dielectric layer for covering a display electrode which is provided on a front substrate and which consists of a scan electrode and a sustain electrode, and a second dielectric layer for covering data electrodes which are provided on a back substrate. The peripheries of the first dielectric layer and/or the second dielectric layer have a radius of curvature of other than 0.

This structure can achieve a plasma display panel which is provided with dielectric layers having a reduced occurrence of disadvantages such as exfoliating, cracking, and chipping, and which therefore creates an excellent screen display.

DETAILED DESCRIPTION OF PREFERRED EMBODIMENT

A plasma display panel according to an embodiment of the present invention will be detailed as follows with reference to accompanying drawings.

Figure 1:
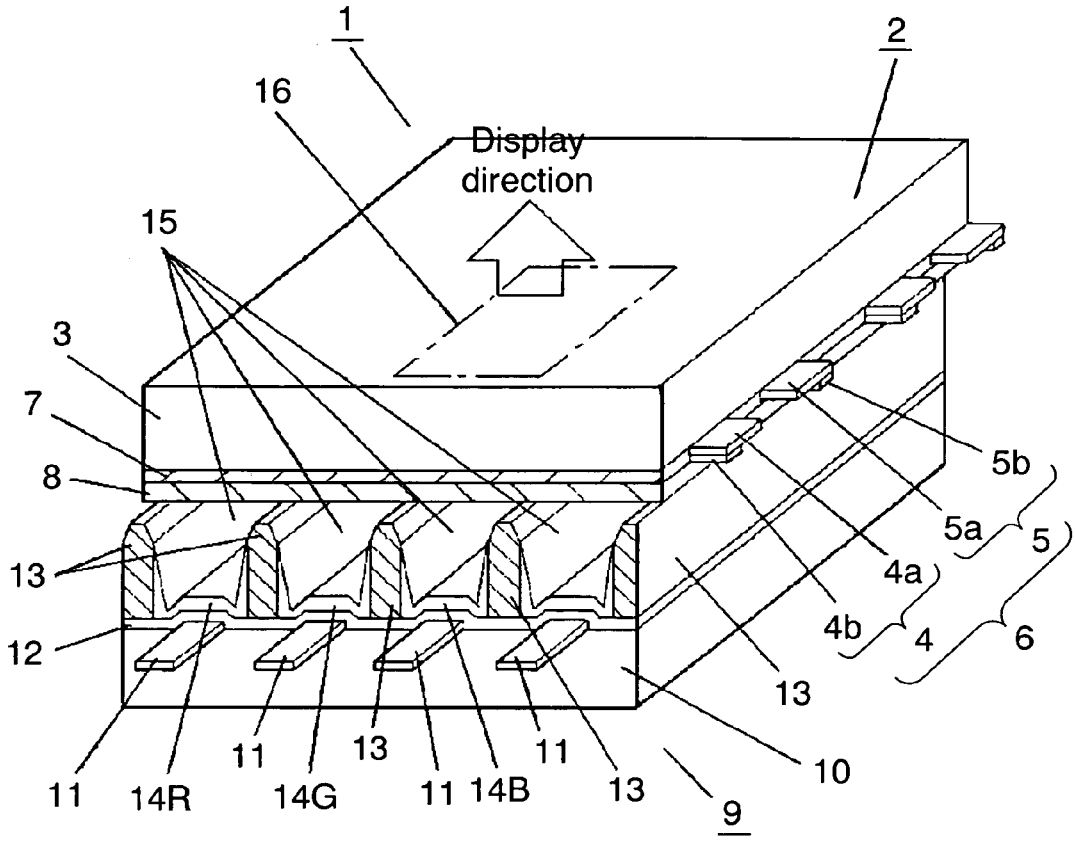
FIG. 1 is a perspective cross sectional view showing a schematic structure of a plasma display panel according to an embodiment of the present invention.

FIG. 1 is a perspective cross sectional view showing a schematic structure of the plasma display panel according to the embodiment of the present invention.

As shown in FIG. 1, PDP 1 is formed of front plate 2 and back plate 9. Front plate 2 includes front substrate 3 made of a transparent and insulating glass substrate or the like; display electrode 6 which is provided on front substrate 3 and which consists of scan electrode 4 and sustain electrode 5; first dielectric layer 7 which covers display electrode 6; and protective layer 8 which is made of MgO film and covers first dielectric layer 7. Scan electrode 4 and sustain electrode 5 are formed by stacking bus electrodes 4*b* and 5*b* made from metallic material onto transparent electrodes 4*a* and 5*a*, respectively, for the purpose of securing light transmission properties and reducing electric resistance. First dielectric layer 7 can be formed by applying dielectric paste containing a powdered glass material with a low melting point by screen coating, die coating, or the like. It is also possible to form first dielectric layer 7 by transferring and pasting a precursor material layer, which is made of dielectric sheet formed into a transfer film, onto the respective substrates, and later by firing the precursor material layers.

On the other hand, back plate 9 includes back substrate 10 made of an insulating glass substrate or the like, data electrodes 11 formed thereon, and second dielectric layer 12 which covers data electrodes 11. In addition, barrier ribs 13 are arranged parallel with data electrodes 11 on second dielectric layer 12. Phosphor layers 14R, 14G, and 14B are provided on the surface of second dielectric layer 12 and on the sides of barrier ribs 13. Similar to first dielectric layer 7, second dielectric layer 12 can be formed by applying dielectric paste containing a powdered glass material with a low melting point by screen coating, die coating, or the like, or by transferring and pasting a precursor material layer, which is made of dielectric sheet formed into a transfer film, onto the respective substrates, and later to sinter the precursor material layers.

Front plate 2 and back plate 9 are disposed to face each other with discharge spaces 15 therebetween so as to make display electrode 16 orthogonal to data electrodes 16, and are sealed with a sealing member formed on the peripheries of these plates. Discharge spaces 15 are filled with at least one kind of rare gas selected from helium, neon, argon and xenon. Discharge spaces 15 are partitioned by barrier ribs 13, and the portions of discharge spaces 15 that are the intersections of display electrode 6 and data electrodes 11 function as discharge cells 16.

Figure 2:
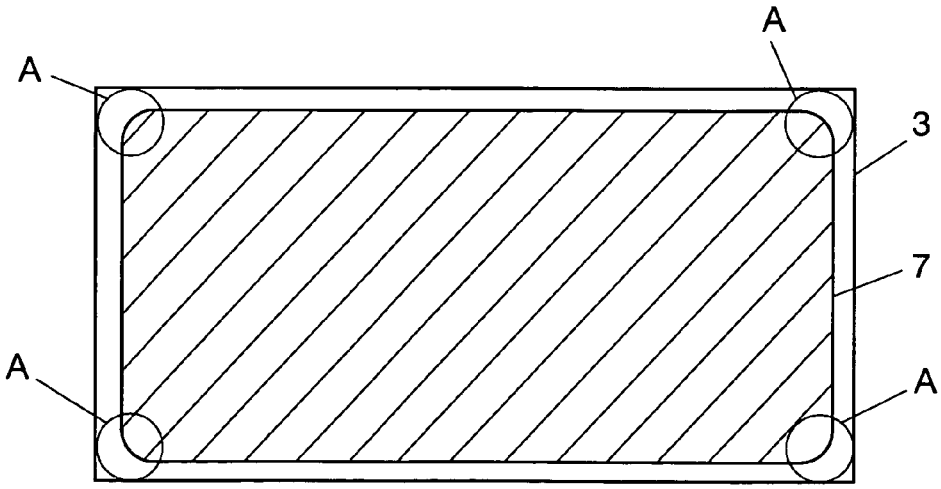
FIG. 2 is a plan view showing a structure of a front plate of the plasma display panel according to the embodiment of the present invention.

The following is a description of first dielectric layer 7 formed on front plate 2. A plan view of the schematic structure of front plate 2 of PDP 1 is shown in FIG. 2 exclusively depicting front substrate 3 and first dielectric layer 7 for simplification. Here, the corner parts of first dielectric layer 7 indicate the four corners shown with the symbol "A" in FIG. 2 when first dielectric layer 7 is shaped as in the drawing, and indicate all the corners when first dielectric layer 7 is polygonal. As an example, the corner parts in the case of a hexagon are shown in FIG. 3 with the symbol "A".

Figure 3:
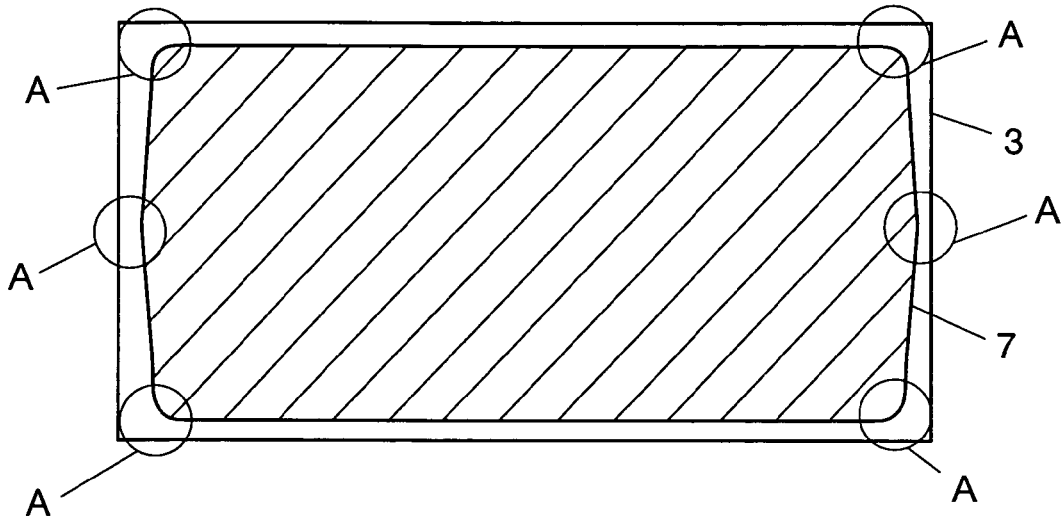
FIG. 3 is a plan view showing another structure of the front plate of the plasma display panel according to the embodiment of the present invention.
Figure 4:
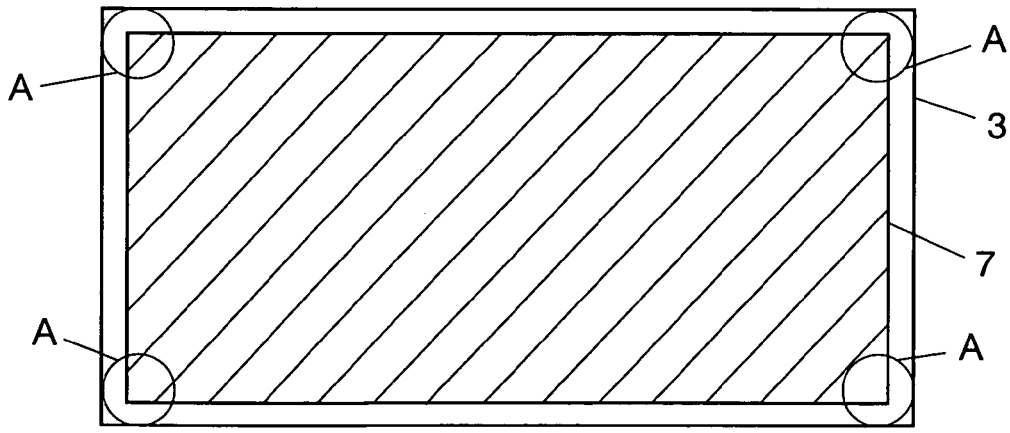
FIG. 4 is a plan view showing a structure of the front plate of a conventional plasma display panel.

In the present invention, the periphery of first dielectric layer 7 has a radius of curvature of other than 0 as shown in FIGS. 2 and 3. This structure can reduce the concentration of stress which results from the difference in thermal expansion with front substrate 3 and which affects the corners indicated with the symbol "A", as compared with the case that the corner parts with the symbol "A" of first dielectric layer 7 form angles or apexes, namely, the radius of curvature is 0 as shown in FIG. 4. As a result, it becomes possible to reduce the occurrence of disadvantages such as exfoliating, cracking, and chipping in the first dielectric layer starting from the corner parts.

Here, having a radius of curvature of other than 0 at the periphery of first dielectric layer 7 means that the periphery of first dielectric layer 7 has no apexes, thereby indicating that the corner parts indicated with the symbol "A" are round-shaped. In contrast, when there are apexes, the periphery includes regions having a radius of curvature of 0.

First dielectric layer 7 is formed by coating or pasting dielectric paste or a resist material containing a powdered glass material with a low melting point as a precursor of first dielectric layer 7 onto the substrate so as to form a precursor layer, and then by applying a firing process. It is possible to round off the corner parts with the symbol "A" at the stage of forming the precursor layer for first dielectric layer 7 onto front substrate 3. Even when the corner parts with the symbol "A" are not rounded off immediately after the formation of the precursor layer onto front substrate 3, the corner parts with the symbol "A" can be rounded off, for example, by making use of the paste fluidity in the drying process or the firing process. In other words, the corner parts with the symbol "A" of first dielectric layer 7 have only to be rounded off during the firing process and in finished form after the firing process, so as to reduce the occurrence of stress resulting from the difference in thermal expansion, thereby obtaining the effects of the present invention.

The following is a description of methods for forming first dielectric layer 7. One method for forming first dielectric layer 7 uses dielectric paste. According to this method, dielectric paste containing a powdered glass material with a low melting point, a binder resin, and a solvent as the precursor material of first dielectric layer 7 is applied onto front substrate 3 by screen printing or another method. Then, the dielectric material is dried to form the precursor layer of first dielectric layer 7, and the precursor layer is sintered to form first dielectric layer 7. In this method, it is possible to round off the corner parts from the beginning as a print pattern, and even when the corner parts with the symbol "A" are not rounded off immediately after the printing, the corner parts with the symbol "A" can be rounded off by making use of the paste fluidity developing in the drying process following the printing. The firing is performed for several minutes to several tens of minutes at a temperature not lower than the softening point of the low-melting-point powdered glass material contained in the dielectric material of first dielectric layer 7 which has undergone the drying process. This firing deprives the precursor layer of first dielectric layer 7 of resin and other components, thereby forming first dielectric layer 7 mainly composed of a glass component.

Another method of forming first dielectric layer 7 uses a photosensitive dielectric material as the precursor material, which is more specifically, dielectric paste containing a powdered glass material with a low melting point, a binder resin, a photosensitive material and a solvent. In this method, it is possible that the dielectric material as a precursor material is applied onto front substrate 3 by die coating or the like, dried, and then patterned to round off the corner parts by a photo litho method, thereby forming the precursor layer of first dielectric layer 7. Later, the precursor layer can be sintered.

Further another method of forming first dielectric layer 7 is a transfer method in which dielectric paste is applied on a support film and dried to prepare a transfer film, and then the dielectric material as a precursor material on the support film of the transfer film is transferred onto the surface of front substrate 3 so as to form a precursor layer. In this method, the precursor layer of first dielectric layer 7 having rounded corner parts can be formed and later sintered by using a photosensitive material or non-photosensitive material as a precursor material. When the non-photosensitive material is used, the precursor material is transferred with the corner parts rounded off in a transferring process.

Such a transfer method is effective when precursor layers for a plurality of plasma display panels are collectively formed on a large-sized glass substrate and then-divided into individual plasma display panels. In this case, by using consecutive transfer films formed of a support film and a dielectric film thereon, transfer is performed sequentially onto the glass substrate which is to be front substrate 3, while cutting the transfer films. However, in such a case, a rectangular transfer film is pasted onto a rectangular glass substrate, so that the corner parts at the periphery of the precursor layer which is to be first dielectric layer 7 pasted on the glass substrate have "apexes" having a radius of curvature of 0. This may lead to exfoliating or chipping starting from the corner parts. However, the aforementioned embodiment of the present invention can reduce the occurrence of such problems because the periphery of first dielectric layer 7 has a radius of curvature of other than 0, and the corner parts are round-shaped.

In the aforementioned case using the transfer method, the corner parts can be rounded off by die cutting after the transfer or by using a photosensitive precursor material to be formed on the support film; transferring the precursor material onto front substrate 3; and patterning the precursor material so as to be rounded off at the corner parts by a photolithography method.

The transfer film can be prepared by applying a dielectric material which is to be a precursor material onto the support film by using a roller coater, a blade coater, a curtain coater, or the like; drying the dielectric material; removing some or all of the solvent contained in the dielectric material; and compression bonding a cover film onto the dielectric material. The process of transferring the dielectric material which is to be the precursor material from the transfer film onto front substrate 3 is as follows. After the cover film is removed from the transfer film, the transfer film is laminated in such a manner that the dielectric material is in contact with the surface of front substrate 3, and the transfer film is thermo-compression bonded by applying a thermo roller thereon. Later, the support film is peeled off. These operations can be done by a laminating device.

On the other hand, in the case that a photosensitive material is used as a precursor material, the corner parts can be rounded off by exposing the precursor layer of first dielectric layer 7 formed on front substrate 3 with ultraviolet rays via a mask having a prescribed shape, and then developing the precursor layer.

Figure 5A:
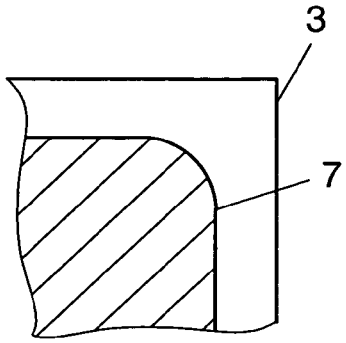
FIG. 5A is a plan view showing a detailed example of a corner part of a first dielectric layer of the plasma display panel of according to the embodiment of the present invention.
Figure 5B:
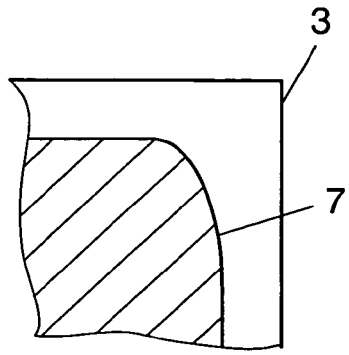
FIG. 5B is a plan view showing another detailed example of a corner part of the first dielectric layer of the plasma display panel according to the embodiment of the present invention.

Corner parts with a round shape, that is, a periphery with a curvature indicates having no angles such as a single curvature as shown in FIG. 5(*a*) or consecutive different curvatures as shown in FIG. 5(*b*), and these can be appropriate to the purpose of the present invention.

Figure 6:
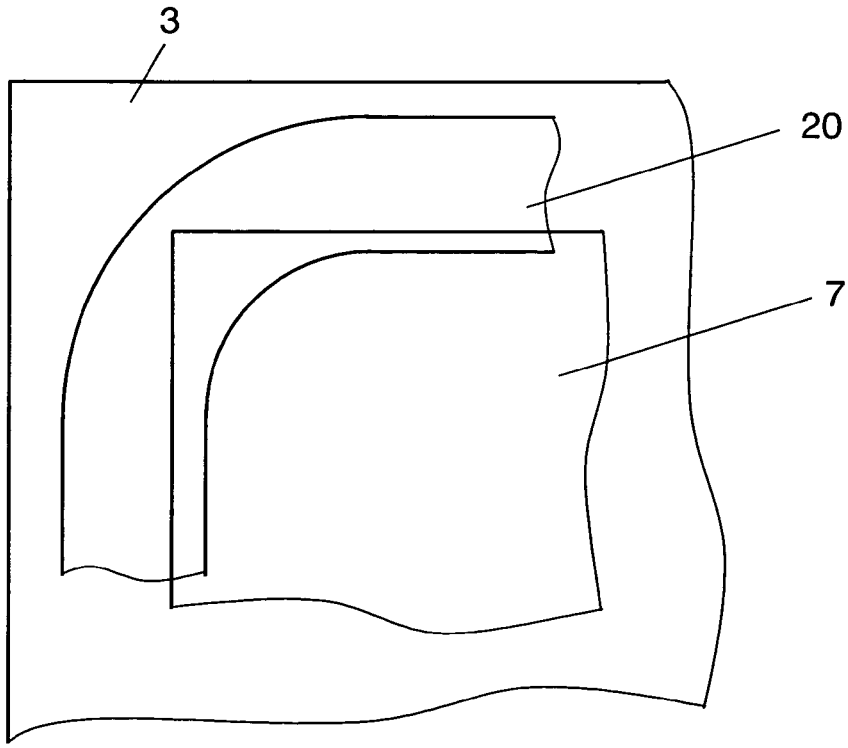
FIG. 6 is a plan view showing a positional relation between a corner part of the first dielectric layer and a sealing member of the plasma display panel.

In the case that the corner parts of first dielectric layer 7 are covered with sealing member 20 as shown in FIG. 6, the corner parts of first dielectric layer 7 are vulnerable to complicated stress concentration resulting from the difference in thermal expansion between front glass substrate 3, seal member 20, and first dielectric layer 7, thereby easily causing disadvantages such as exfoliating and cracking. However, the occurrence of the exfoliating and cracking of first dielectric layer 7 can be reduced by applying the present invention to such a structure.

Although first dielectric layer 7 of front plate 2 has been exclusively described, the same effects are applied to second dielectric layer 12 covering data electrodes 11 formed on back plate 9.

INDUSTRIAL APPLICABILITY

The present invention can achieve a plasma display panel provided with dielectric layers having a reduced occurrence of disadvantages such as exfoliating, cracking or chipping, and the plasma display panel can be applied to plasma display devices that create an excellent screen display.

The invention claimed is:

1. A plasma display panel comprising:

a first dielectric layer having a substantially rectangular shape for covering a display electrode and a front substrate, the display electrode being formed on the front substrate and including a scan electrode and a sustain electrode;

a second dielectric layer having a substantially rectangular shape for covering a data electrode and a back substrate, the data electrode being formed on the back substrate; and a barrier disposed on the second dielectric layer, wherein at least one of the first dielectric layer and the second dielectric layer in plane view has four corners with a radius of curvature of other than zero, and each of the four corners is where two sides of the substantially rectangular shape meet.

2. The plasma display panel according to claim 1, wherein at least one of the first dielectric layer and the second dielectric layer is formed by firing a precursor material layer transferred from a transfer film, the precursor material layer has a substantially rectangular shape, and four corners of the substantially rectangular shaped precursor material layer are rounded.

3. The plasma display panel according to claim 1, wherein at least one of the first dielectric layer and the second dielectric layer is formed by firing a precursor material layer having photosensitivity, the precursor material layer has a substantially rectangular shape, and four corners of the substantially rectangular shaped precursor material layer are rounded.

* * * * *